United States Patent [19]

Wade et al.

[11] 4,394,226

[45] Jul. 19, 1983

[54] ELECTROLYTIC METHOD FOR PRODUCING QUATERNARY AMMONIUM HYDROXIDES

[75] Inventors: Robert C. Wade, Ipswich; Lawrence J. Guilbault, Topsfield, both of Mass.

[73] Assignee: Thiokol Corporation, Chicago, Ill.

[21] Appl. No.: 287,594

[22] Filed: Jul. 28, 1981

[51] Int. Cl.[3] ..... C25B 1/00; C25B 3/00

[52] U.S. Cl. ..... 204/72; 204/102; 204/128; 204/129

[58] Field of Search ..... 204/102, 72, 296, 128, 204/129

[56] References Cited

U.S. PATENT DOCUMENTS

| | | | |
|---|---|---|---|
| 3,402,115 | 9/1968 | Campbell et al. | 204/72 |
| 3,523,068 | 8/1970 | Eisenhauer et al. | 204/72 |
| 4,025,405 | 5/1977 | Dotson et al. | 204/98 |

OTHER PUBLICATIONS

"The Elements of P. Chem.", by Glasstone, 1946, p. 400.

"New Ion Exchange Membrane Vital in Disinfecting Sewage", Dupont, pp. 1-3, 12-1-72.

Handbook of Chem. & Physics, p. 692.

Ionics Incorporated, "Ionics Electrochemical Cells for the Production of TMOH from TMCL", Jan. 1973.

Ionics Incorporated, Brochure describing Electrochemical Membrane Cell Systems, copyright 1976.

*Primary Examiner*—R. L. Andrews

*Attorney, Agent, or Firm*—Gerald K. White

[57] ABSTRACT

Quaternary ammonium hydroxides are prepared by the electrolysis of quaternary ammonium halides in electrolytic cells having the anode and cathode separated by a cation exchange membrane.

13 Claims, 1 Drawing Figure

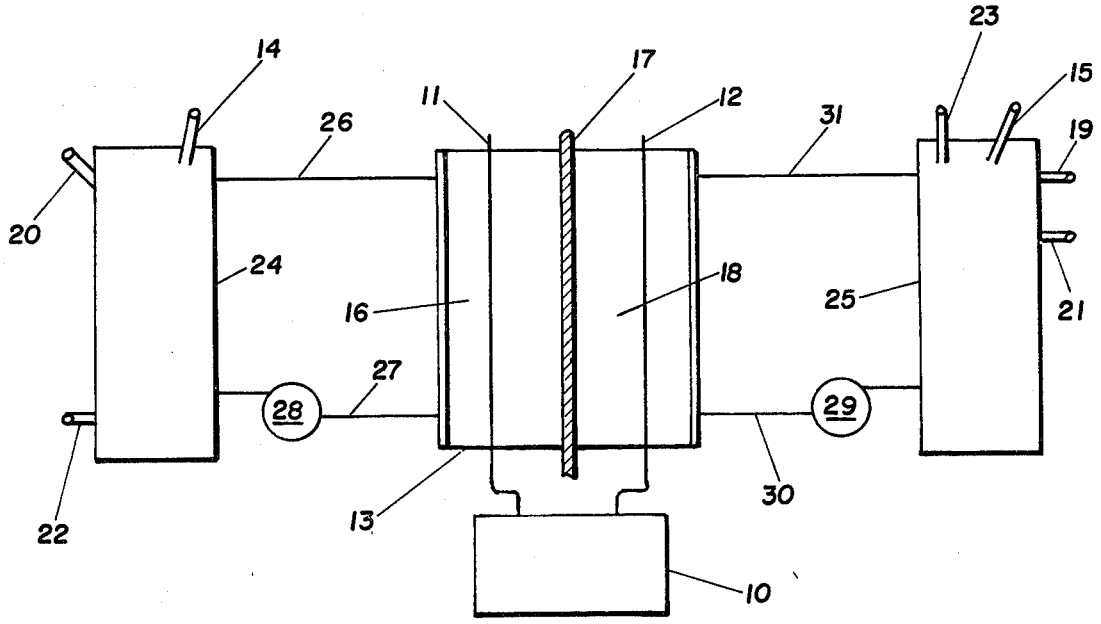
14
26
11
17
12
31
23
15
19
20
24
16
18
25
21
27
28
29
22
13
30
10

ELECTROLYTIC METHOD FOR PRODUCING QUATERNARY AMMONIUM HYDROXIDES

BACKGROUND OF THE INVENTION

Quaternary ammonium hydroxides such as tetramethylammonium hydroxide (TMAH) are strong organic bases that have been known for many years. This compound has been available commercially as the solid pentahydrate and as solutions in methanol and water. TMAH has been used mainly in analytical chemistry as a titrant for acids in organic solvents and as a supporting electrolyte in polarography. These uses are based upon good solubility in alcohols and a relative freedom from alkali metal impurities. Aqueous solutions of TMAH have been used extensively as a developer for photoresists in printed circuit board and microelectronic chip fabrication. Use in the electronics area requires that there be no residue following the normal post bake period. Even traces of alkali metals would interfere in the operation of the electronic circuits. Accordingly, impurity specifications for TMAH to be used in electronics are much stricter than had been acceptable previously. Current requirements, based on contained TMAH, are: $\leqq$4000 ppm Cl, Br, I or carbonate and $\leqq$10 ppm each of Li, Na, K. However, it is advantageous to the electronics fabricator to employ TMAH in which the above mentioned impurities approach zero.

Quaternary ammonium hydroxides such as TMAH have been produced by various techniques. For example, aqueous solutions of tetramethylammonium halides have been reacted with a suspension of silver oxide to produce TMAH. Such procedure is considered to be somewhat laborious, expensive, and results in silver ion contamination of the final product. Another metathesis reaction utilizes tetramethylammonium chloride (TMACl) and potassium hydroxide in methanol with the precipitated potassium chloride being filtered from the methanol solution of TMAH. The resultant product contains chloride and potassium concentrations that are considered to be excessive for electronic quality applications. A third metathesis route involves the treatment of the corresponding oxalate or carbonate in aqueous solution with an excess calcium hydroxide suspension. This technique is further described in French Pat. No. 1,546,227.

Anion exchange resins have also been utilized in connection with the manufacture of TMAH from the chloride. Ion exchange techniques are considered to be acceptable for use in the production of laboratory quantities of quaternary ammonium hydroxide but are considered to be impractical for producing larger quantities due to high resin volume requirements.

A third general method involves the electrolysis of certain tetramethylammonium salt solutions. Typical of such processes include those shown in U.S. Pat. Nos. 3,402,115 and 3,523,068. These techniques involve the electrolytic treatment of quaternary ammonium salts containing non-electrolyzable anions. Other techniques included U.S. Pat. Nos. 2,363,387 and an article entitled "Preparation of Tetramethylammonium Hydroxide by Electrolysis" by S. Krishnan et al., Denki Kagaku Oyobi Kogyo Butsuri Kagaku 1971, 39 (3), 221-2 (Japan).

It is also known to utilize an oxidation-reduction cell employing a cationic membrane process for the electrolytic conversion of TMACl to TMAH. Such process is believed to represent the current state of the art for preparing low impurity level TMAH for electronics fabrication application. The transport characteristics of the cationic membrane of this known process result in an upper attainable product concentration limit of less than about 25%. Because TMAH is commonly supplied for electronics applications as a solid pentahydrate ($TMAH \cdot 5H_2O$ ) which contains approximately 50% TMAH by weight, TMAH solution from this known electrolytic cell process must then be concentrated from the upper attainable concentration limit of less than about 25% by use of stripping, evaporation, or crystallization processes. These additional manufacturing steps add to the complexity and cost of manufacture. Furthermore, elevated temperature concentrating processes can lead to thermal degradation of the product.

In contrast, the invention of this application discloses an improved electrolytic method for producing quaternary ammonium hydroxide such as TMAH which results in product concentrations greater than 25 wt. % and even up to 50 wt. %. The latter wt. % results in a solid TMAH product. The products of the invention are substantially free from harmful carbonates and alkali metal contaminants such as Na, Li, and K and halides such as Cl, Br, and I and are thus acceptable for use as a developer for photoresists in electronic applications.

SUMMARY OF THE INVENTION

This invention generally comprises a process for producing quaternary ammonium hydroxides in electrolytic cells having compartments containing an anode and a cathode. These compartments are separated by a cationic membrane capable of rejection of passage of essentially all halide anions from the anode compartment to the cathode compartment and capable of permitting a passage of hydrated quaternary ammonium cations from the anode to cathode compartment. A solution of quaternary ammonium halide is fed into the anode compartment and water is fed into the cathode compartment. Sufficient electrical potential is established and maintained between the anode and cathode to produce a flow of electrical current across said cell that causes halide ions to lose an electron at said anode and to combine to form halogen molecules, hydrated quaternary ammonium ions to migrate through the membrane from the anode compartment into the cathode compartment and to combine with hydroxide ions to form essentially halide free quaternary ammonium hydroxide, and to dissociate water at the cathode to form hydrogen and hydroxide ions. A product containing greater than 25 wt. % TMAH is produced in and removed from the cathode compartment.

BRIEF DESCRIPTION OF THE DRAWING

The sole FIGURE is a schematic cross-sectional drawing of a typical electrolytic cell useful in performing the process of the inventions.

DETAILED DESCRIPTION OF THE INVENTION

A schematic cross-sectional representation of an electrolytic cell suitable for conducting the process of the invention is shown in FIG. 1. Using the conversion of TMACl to TMAH as a representative example, the cell functions to effect the overall reaction shown below:

$$2TMA^+Cl^- + 2H_2O \rightarrow 2TMAH + H_2\uparrow + Cl_2\uparrow$$

An electrical potential is established and maintained by power source 10 between anode 11 and cathode 12 to produce a flow of current across cell 13 to convert chloride ions into chlorine gas at anode 11 and water to dissociate into hydrogen gas and hydroxide ions at cathode 12. Chlorine gas and hydrogen gas pass off at the anode and cathode, and are collected and passed away at gas collection means 14 and 15 respectively. In addition, the current flow causes TMA ions to migrate from anode compartment 16 through cationic membrane 17 into cathode compartment 18 where the tetramethylammonium and hydroxide ions combine to form a solution of TMAH. The TMAH solution is removed from this compartment through removal means 19. TMACl and water may be periodically or continuously added, through feed means 20 and 21, respectively, to maintain an appropriate concentration in the respective compartments. TMACl solution is contained in anolyte tank 24. Such solution may be continuously or periodically circulated to and from anode compartment 16 with use of lines 26 and 27. Circulation is effected by pump 28. Line 27 serves to pass the TMACl solution into anode compartment 26 while line 26 serves as an exit line for TMACl solution and chlorine gas. TMAH solution is contained in catholyte tank 25. Such solution may be continuously or periodically circulated to and from cathode compartment 18 with use of lines 30 and 31. Circulation is effected by pump 29. Line 30 serves to pass the TMAH solution into cathode compartment 18 while line 29 serves as an exit line for TMAH solution and hydrogen gas. Spent solution may be removed from the anode compartment by removal means 22. Inert gas inlet 23, is provided to blanket the cathode compartment and catholyte tank. Typically nitrogen or other gases such as argon or other noble gases that are inert to TMAH may be used.

The type of electrolytic cell that may be used in connection with the process of the invention is not limited. For example, such well known cells as the filler press or finger type may be utilized. Conventional cell materials that are compatible with the materials being treated are used in the construction of the cell.

The anode and cathode do not directly enter into the reaction and thus may be made from materials that do not react with the baths. While a variety of such materials may be used, ruthenized titanium anodes and nickel-plated titanium cathodes have been utilized successfully. Nickel functions as a catalyst for hydrogen evolution in basic solutions. Other suitable anode materials include but are not limited to platinized titanium. Other suitable cathode materials include but are not limited to glassy carbon, or stainless steel.

Suitable cationic membranes for the invention include fluorinated membranes conveying cation exchange groups conveying cation exchange groups such as perfluorosulfonic acid perfluorocarbon polymer membrane, which is sold under the trademark "NAFION" by E. I. DuPont de Nemours & Company, Wilmington, Delaware. It is specifically contemplated that NAFION 425 membranes may be so utilized. Perfluorosulfonic acid perfluorohydrocarbon polymer membranes may have the following structure:

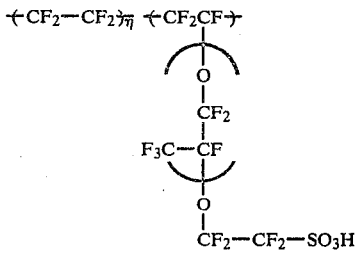

in which the concentration of exchange groups are described as about 1,100 to 1,500 g of dry membrane per an equivalent of $SO_3^-$ exchange groups. Such cation exchange membranes may be also employed as having weak acid groups of carboxylic acid, phosphoric acid and the like, solely or in combination of sulfonic acid aforesaid. Such membrane is further described in U.S. Pat. No. 4,240,883 in connection with its use in the electrolysis of an aqueous alkali metal chloride solution to produce aqueous alkali metal hydroxides.

It has been discovered that solid TMAH (e.g. pentahydrate, TMAH-$5H_2O$—about 50% TMAH by weight) or highly concentrated solutions thereof (in excess of 25 wt. % TMAH) that are essentially free of undesirable impurities such as $Cl^-$, $CO_3^=$, $Na^+$, $K^+$ and $Li^+$, and therefore of value in microcircuit fabrication processes, can be produced by practice of the process of the invention. In this connection it is advantageous to employ relatively dilute aqueous solutions of TMACl (e.g., ≦25%), containing low levels (e.g. ≦5 ppm) of alkaline metal ion impurities, as the feedstream. Because Donnan equilibrium theory predicts that the chloride concentration in the product side will approximate the square root of that in the reactant side. TMACl concentrations in the feed stream on the order of 0.1 to 1.0% are preferred. In addition, NAFION 425 cationic membrane or its equivalent should be used. This membrane material provides for virtually total anion rejection, and in addition serves to enrich the TMAH concentration in the catholyte chamber. As will become apparent later, other NAFION-type membranes such as NAFION 315 do not appear to function as effectively as NAFION 425 with respect to restriction of alkali metal and halide passage through the membrane into the cathode chamber. It has also been found to be advantageous to utilize a protective gaseous atmosphere such as nitrogen or argon in the catholyte tank and cathode compartment to prevent or substantially minimize reaction of the quaternary ammonium hydroxide with carbon dioxide in the air to form carbonate impurities. It is also been discovered that treatment of the membrane prior to use in the process with a mineral acid leads to improved product purity. Such treatment achieves equilibrium with the TMAH solution and serves to leach out undesirable organic and ionic impurities in the membrane that would otherwise contaminate the TMAH. The following procedure has proven to be advantageous in this regard:

a. Boil one hour in 1 M. $H_2SO_4$
b. Rinse with deionized water
c. Soak for 24 hours in 1 M TMAH The following examples demonstrate the improvement in product quality that can be obtained by following the above described process improvement steps.

EXAMPLE 1

A 0.3 $FT^2$ electrolyte cell was assembled with NAFION 315 membrane that was not previously submitted to a pretreatment process. A ruthenized titanium anode and a nickel plated cathode were used. A 40% TMACl solution and a 9.25% TMAH solution were circulated through the anolyte and catholyte compartments respectively, while a current of 48 amperes was applied to the cell. After nine hours of operation, the TMAH concentration in the catholyte compartment had reached an upper limiting level, and samples of the anolyte and catholyte streams were analyzed with the following results:

| Anolyte | Catholyte |
|---|---|
| 25.16% TMACl | 22.47% TMAH |
| 4 ppm $Na^+$ | 80 ppm $Cl^-$ |
| 0.5 ppm $K^+$ | 6 ppm $Na^+$ |
| | 1.4 ppm $K^+$ |
| | 0.3% Carbonate |

EXAMPLE 2

A 15 $in^2$ electrochemical cell was assembled with a NAFION 425 membrane, ruthenized titanium anode and nickel-plated titanium cathode. The membrane was pretreated by boiling for one hour in a $H_2SO_4$, washing in deionized water and soaking in 1 M TMAH for 24 hours prior to cell assembly.

A feedstream of 0.1 M TMACl was circulated through the anolyte chamber, while a dilute solution of TMAH (pH=12.6) was employed as the circulating fluid in the catholyte chamber to provide electrical conductivity.

Upon application of an electrical current, tetramethylammonium ions passed rapidly through the membrane accompanied by about six moles of water, one of which is converted by the cathode into hydrogen and hydroxyl ions.

After operating the cell for a period of time, solid TMAH pentahydrate was observed to form in the cathode compartment. This solid (ca., 50% TMAH) could be isolated directly, or alternatively, dilution water can be circulated through the cathode compartment to prepare solutions at any concentration below 50%.

Analysis of a TMAH solution prepared in this manner showed no detectable chloride ion contaminants, and no concentrating transfer of alkali metal ion impurities from the feedstream to the product solution thus illustrating the significance of several of the processing steps and procedures.

We claim:

1. A process for producing quaternary ammonium hydroxide in an electrolytic cell having an anode compartment containing an anode and a cathode compartment containing a cathode, said anode and cathode compartments being separated by a cationic membrane that has been treated with a mineral acid prior to use in the process and is capable of rejection of passage of essentially all halide anions from said anode compartment to the cathode compartment and capable of permitting a passage of hydrated quaternary ammonium cations from the anode to cathode compartment, comprising: feeding a solution of a quaternary ammonium halide into said anode compartment; feeding water into said cathode compartment; establishing and maintaining a sufficient electrical potential between said anode and cathode to produce a flow of electrical current across said cell thereby causing halide ions to lose an electron at said anode, and combine to form halogen molecules, hydrated quaternary ammonium ions to migrate through said membrane from said anode compartment into said cathode compartment and to combine with hydroxide ions to form quaternary ammonium hydroxide that is essentially free of halide, and to dissociate water at the cathode to form hydrogen and hydroxide ions; and removing a product containing greater than 25 wt. % of quaternary ammonium hydroxide from said cathode compartment.

2. The process of claim 1, wherein the feed solution concentration ranges from 0.01% to 25.0%.

3. The process of claim 2, wherein the feed solution concentration ranges from 0.1 to 1.0%.

4. The process of claim 1, wherein:

said cation exchange membrane is comprised of a perfluorosulfonic acid.

5. The process of claim 1 which further includes:

providing an inert gas atmosphere in said cathode compartment to prevent formation of carbonate impurities in said quaternary ammonium hydroxide products.

6. The process of claim 1, wherein:

said quaternary ammonium halide is tetramethylammonium chloride and said quaternary ammonium hydroxide is tetramethylammonium hydroxide.

7. The process of claim 1, wherein the cation exchange membrane is treated by washing with a mineral acid, water rinse and placed into equilibration with quaternary ammonium hydroxide prior to use in the process.

8. A process for producing quaternary ammonium hydroxide in an electrolytic cell having an anode compartment containing an anode and a cathode compartment containing a cathode, said anode and cathode compartments being separated by a cationic membrane capable of rejection of passage of essentially all halide anions from said anode compartment to the cathode compartment and capable of permitting a passage of hydrated quaternary ammonium cations from the anode to cathode compartment, comprising: feeding a solution of a quaternary ammonium halide into said anode compartment; feeding water into said cathode compartment; establishing and maintaining a sufficient electrical potential between said anode and cathode to produce a flow of electrical current across said cell thereby causing halide ions to lose an electron at said anode, and combine to form halogen molecules, hydrated quaternary ammonium ions to migrate through said membrane from said anode compartment into said cathode compartment and to combine with hydroxide ions to form quaternary ammonium hydroxide that is essentially free of halide, and to dissociate water at the cathode to form hydrogen and hydroxide ions; and removing a product containing greater than 25% of quaternary ammonium hydroxide from said cathode compartment; said process further comprising the step of providing an inert gas atmosphere in said cathode compartment to prevent formation of carbonate impurities in said quaternary ammonium hydroxide.

9. The process of claim 8, wherein the feed solution concentration ranges from 0.1% to 25.0%.

10. The process of claim 9, wherein the feed solution concentration ranges from 0.1 to 1.0%.

11. The process of claim 8, wherein: said cation exchange membrane is comprised of a perfluorosulfonic acid.

12. The process of claim 8, wherein: said quaternary ammonium halide is tetramethylammonium chloride and said quaternary ammonium hydroxide is tetramethylammonium hydroxide.

13. The process of claim 8, wherein the cation exchange membrane is treated by washing with a mineral acid, water rinse and placed into equilibration with quaternary ammonium hydroxide prior to use in the process.

* * * * *